United States Patent [19]

Doyle

[11] Patent Number: 5,018,731

[45] Date of Patent: May 28, 1991

[54] GOLF BALL DRIVING PRACTICE APPARATUS

[76] Inventor: Keith A. Doyle, 21 Woodshed Ter., Wrightsville, Pa. 17368

[21] Appl. No.: 617,663

[22] Filed: Nov. 26, 1990

[51] Int. Cl.[5] ..... A63B 69/36; A63B 67/02

[52] U.S. Cl. ..... 273/35 B; 273/182 A; 273/201; 273/181 F

[58] Field of Search ..... 273/35 R, 35 A, 35 B, 273/182 R, 182 A, 181 F, 181 D, 181 E, 176 F, 176 FA, 176 FB, 176 H, 176 J, 176 B

[56] References Cited

U.S. PATENT DOCUMENTS

| | | | |
|---|---|---|---|
| 1,218,390 | 3/1917 | Gates | 273/182 A |
| 1,669,640 | 5/1928 | Warlick | 273/176 F |
| 3,390,882 | 7/1968 | Megerle | 273/182 R |
| 3,643,959 | 2/1972 | Cornell et al. | 273/176 FA |
| 3,895,809 | 7/1975 | Shockley | 273/182 R |
| 4,381,110 | 4/1983 | Balaz | 273/182 R |
| 4,556,219 | 12/1985 | Tillery | 273/181 F |
| 4,703,931 | 11/1987 | Steen | 273/26 A |
| 4,883,272 | 11/1989 | Lay | 273/26 A |

*Primary Examiner*—George J. Marlo
*Attorney, Agent, or Firm*—Samuel M. Learned, Jr.

[57] ABSTRACT

A golf ball driving practice apparatus comprised of a rigid framework assembly which supports a conical net into which a player practice drives golf balls off a tee provided in a platform at the open end of the conical net, and being also provided with mechanical provisions for automatic spent golf ball return to the platform position so that upon coin activated dispensing of returned balls a player either commences or continues practice golf ball driving, further wherein the apparatus hereof is suitable for either indoor or outdoor driving range applications as well as use at various convenient golf course locations so that a golfer on the golf course is enabled to practice drive golf balls near a playing tee without the bother or inconvenience of interfering with other players or having to retrieve the balls.

20 Claims, 4 Drawing Sheets

GOLF BALL DRIVING PRACTICE APPARATUS

BACKGROUND OF THE INVENTION

The present invention relates to a golf ball driving practice apparatus for use as a means whereby golfers may actually practice drive golf balls prior to teeing off when such apparatus are positioned at convenient golf course locations, or where there are restricted golf ball driving practice constraints in not only breadth and length but also elevation the apparatus may be adapted for use in both indoor and outdoor driving range applications. The primary intended use of the golf ball driving practice apparatus hereof, however, is to enable a golfer on the golf course during the conduct of actual play to practice drive golf balls near a playing tee without the bother or inconvenience of interfering with other players or having to retrieve the balls.

The prior art does teach various golf ball driving practice and training devices comprised of a frame structure supporting a receiving net to serve as a means whereby golfers may conveniently and easily practice golf ball driving in a confined area, exemplary of which would be those as respectively shown in U.S. Pat. No. 4,381,110 to Balaz dated Apr. 26, 1983, and U.S. Pat. No. 4,556,219 to Tillery dated Dec. 3, 1985, the latter of which also teaches a spent golf ball receiving and collection section generally as shown at 12 therein.

Although not designed for golf ball driving practice per se, the ball catching frame component of U.S. Pat. No. 4,883,272 to Lay dated Nov. 28, 1989, does show a ball return and collection structure somewhat similar to that employed by applicant herein, as best illustrated in FIGS. 2 and 3 thereof at 19.

The teaching of Steen in U.S. Pat. No. 4,703,931 dated Nov. 3 1987, shows an apparatus for returning a ball which employs a truncated conical net and rear net attachment means comprised of multiple cord-to-frame connecting strands, being functionally similar but structurally distinguished from the conical net and rear net connecting means employed by applicant herein.

Lastly, the golf game device shown by Cornell et al in U.S. Pat. No. 3,643,959 dated Feb. 22, 1972, teaches a rather sophisticated golf ball driving measurement and analysis device which is at the upper end of the line in terms of complexity and cost when it comes to an apparatus for golf ball driving practice, and clearly in the complexity aspect is both functionally and structurally distinguished from applicant's teaching.

The applicant's golf ball driving practice apparatus is designed and targeted to filling an intermediate need between the quite simple and highly complex practice devices, wherein the advantages of both durability and reliability, as well as portability, of a relatively simple mechanical structure are retained, while the self-contained ease and convenience of a practical and realistic on-site golf ball driving practice capability at the golf course location is afforded, wherein the current invention is distinguished over the previous teachings in that it does provide a new and novel apparatus and method for achieving the foregoing.

SUMMARY OF THE INVENTION

It is the principal object of the present invention to provide a golf ball driving practice apparatus for either indoor or outdoor use by golfers in practicing golf ball drives, wherein the apparatus may be erected and installed at a golf ball driving range facility or upon a golf course convenient to teeing off locations such that a player may quickly and easily execute several practice drives prior to teeing off in actual play.

It is also an object of the present invention to provide a golf ball driving practice apparatus which is self contained and of sturdy construction, yet sufficiently mobile as to be easily disassembled and removed from one use location and relocated and erected at another.

It is a further object of the present invention is to provide a golf ball driving practice apparatus which provides a flexible ball receiving target adapted to quickly and safely arrest and absorb the kinetic energy of a driven golf ball.

Yet another object of the present invention is to provide a golf ball driving practice apparatus constructed of materials which are impervious to inclement weather conditions so that the apparatus may be used and left erected in outdoor conditions without deleterious effect.

It is another object of the present invention to provide a golf ball driving practice apparatus which enables a golfer on the golf course to practice driving golf balls near a playing tee location without the bother or inconvenience of interfering with other players or having to retrieve the balls.

It is also an object of the present invention to provide a golf ball driving practice apparatus which not only functions to receive and retard forward movement of a driven golf ball propelled thereagainst, but then automatically direct the spent ball to a return for coin activated player release and reuse.

Still another object of the present invention is to provide a golf ball driving practice apparatus which in alternate embodiment forms thereof provides multiple player positions for use in either outdoor or indoor golf ball driving range applications, or in any golf ball driving range use location which is of a relatively confined area.

The foregoing, and other objects hereof, will be readily evident upon a study of the following specification and accompanying drawings comprising a part thereof.

DETAILED DESCRIPTION OF THE INVENTION

Figures 1, 7, 8:
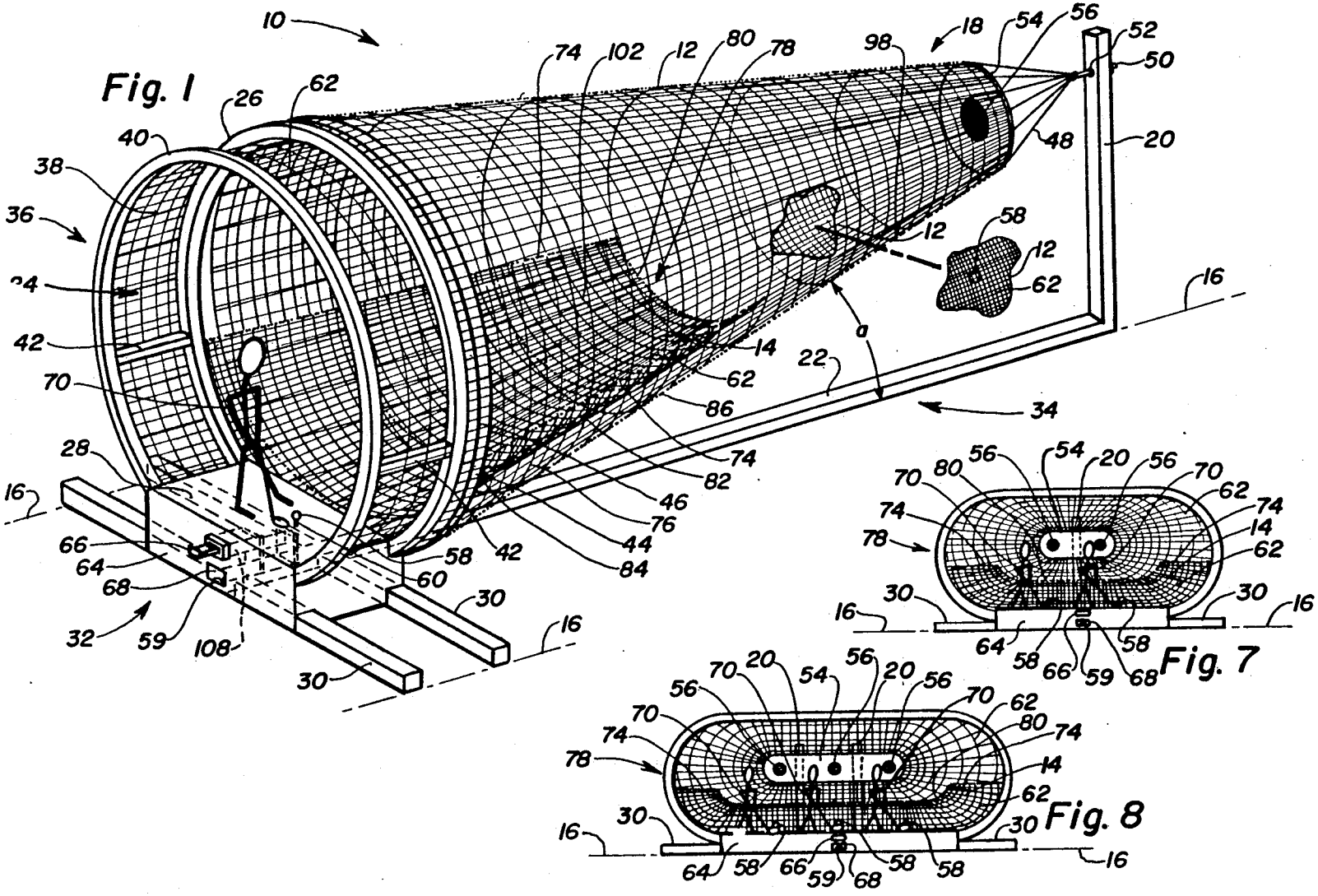
FIG. 1 is a perspective elevation view of the golf ball driving practice apparatus comprising the present invention.
FIG. 7 is a simplified front elevation view of a double-position golf ball driving practice apparatus as taught by the present invention.
FIG. 8 is a simplified front elevation view of a triple-position golf ball driving practice apparatus as taught by the present invention.

Referring to FIG. 1, a preferred embodiment rendering of the golf ball driving practice apparatus 10 of present invention is shown in a perspective elevation view thereof as the same would typically appear in a use installed disposition such as at a golf course or driving range facility, said apparatus 10 being comprised of a truncated conical shaped golf ball receiving and return net 12 having provided therein an integral spent golf ball directing and return apron 14 all of which is supported generally in a slight angularly extending elevated disposition to the horizontal ground surface plane 16 from the net divergent end 18 thereof by means of the upward projecting foot 20 of an L-shaped frame member 22 and being supported at the base end 24 thereof in an open disposition by means of a circular net opening and connecting frame 26 that is connectably assembled to a player positioning and support platform 28 in turn stabilized by a spaced set of apparatus cross support members 30, and containing within the platform 28 base structure a golf ball receiving and dispensing means 32.

Referring again to FIG. 1 to describe in greater detail the additional structural features of the golf ball driving practice apparatus 10 invention hereof. As can be seen in FIG. 1, the physical structure of apparatus 10 is of a relatively simple design and construction, and provides primarily an interconnected net supporting and stretching frame assembly 34 comprised basically of the L-shaped frame member 22 with the upward projecting foot 20 at the net divergent end 18 and the circular net opening and connecting frame 26 at the net open base end 24, in turn being interconnectably assembled to the player positioning and support platform 28 as shown, all of which net supporting and stretching frame assembly 34 structure is stabilized upon the horizontal ground surface plane 16 at the installation site by means of the platform 28 connected spaced set of apparatus cross support members 30 also as shown. The apparatus 10 structure additionally provides a player cage 36 which outwardly extends from the net open base end 24 and provides a safety netted enclosure about the player positioning and support platform 28 so that during use a "sliced" ball or the like will not create a hazard to other people in the immediate area but be intercepted and contained by the safety net 38 which is supported in stretchable affixment between the circular net opening and connecting frame 26 and the safety net attachment frame 40. As shown, the safety net attachment frame is held in a stabilized spaced relationship to the circular net opening and connecting frame 26 by also being connectably assembled to the forward end of the platform 28 and by attachment frame spacers 42 to which said connecting and attachment frames 26 and 40 respectively are also interconnectably joined and additionally secured.

Mechanical means for joining the various interconnected net supporting and stretching frame assembly components one to the other is by drill-and-tap, nut-and-bolt, or other standard mechanical connecting means of those types which allow for ease of field assembly and disassembly and are well known to those of ordinary skill in the art.

Once the interconnected net supporting and stretching frame assembly 34 is erected as shown, then the open base end 24 of the net 12 is assembled to the circular net opening and connecting frame 26 by circumferentially slipping said open base end 24 over the circular net opening and connecting frame collar 44 and thereafter frictionally assembling said open base end 24 thereto by means of tightening and securing the open base end compression draw cord 46 in close compressively pliable communication circumferentially about said collar 44. The net divergent end 18 of the net 12 is then extended away from the open base end 24 thereof at a slight angularly elevated disposition to the horizontal ground surface plane 16, said slightly angularly elevated disposition being denomenated as angle "a" and of a sufficient slope to cause a spent golf ball to roll back down the incline thereof to the golf ball receiving and dispensing means 32 as will be hereinafter more fully explained, whereby the net divergent end connecting cords 48 can be engaged and held in an elevated net-stretching disposition by turnbuckle 50 which is assembled through an opening 52 in the upward projecting end of the upward projecting foot 20. I will be noted, as shown, the net divergent end 18 of said apparatus 10 is closed by an impact disk 54 installed as a solid base which multiply functions first as a structural means to hold the net divergent end 18 in an open truncated cone disposition, second as a solid assembly point for structurally terminating the net divergent end net material as well as to which to join the net divergent end connecting cords 48, and third to functionally provide a wear resistant impact target 56 at which players aim when practice driving a golf ball 58 off the tee 60.

The break-away portion of net 12 shown in FIG. 1 illustrates that the mesh 62 thereof is substantially smaller than the size of a golf ball 58, thereby preventing the passage of a golf ball 58 therethrough. It is to be understood that the spent golf ball directing and return apron 14 and safety net 38 are also provided with nets of similar meshes 62 to likewise prevent the passage of a golf ball 58 therethrough.

The golf ball receiving and dispensing means 32 is supported within the platform enclosure 64 and is mechanically activated by a coin release mechanism 66 to deliver a pre-set number of golf balls 58 to the golf ball delivery 68, all of which mechanism will be discussed in greater detail on consideration of FIG. 2 and certain other subsequent Figures hereinafter. Suffice it at this point to say, however, the player 70, by effecting coin operated functioning of the coin release mechanism 66 of the golf ball receiving and dispensing means 32 releases to receive at the golf ball delivery 68 a set number of golf balls 58 for practice driving.

The interconnected net supporting and stretching frame assembly 34 is preferably constructed of aluminum, but any suitable material such as other metal alloys, plastics, or combinations thereof may also be used. The net 12 and apron 14 as well as the safety net 38 are preferably made of nylon, but again, any other suitable material or combinations thereof may be used.

Figure 2:
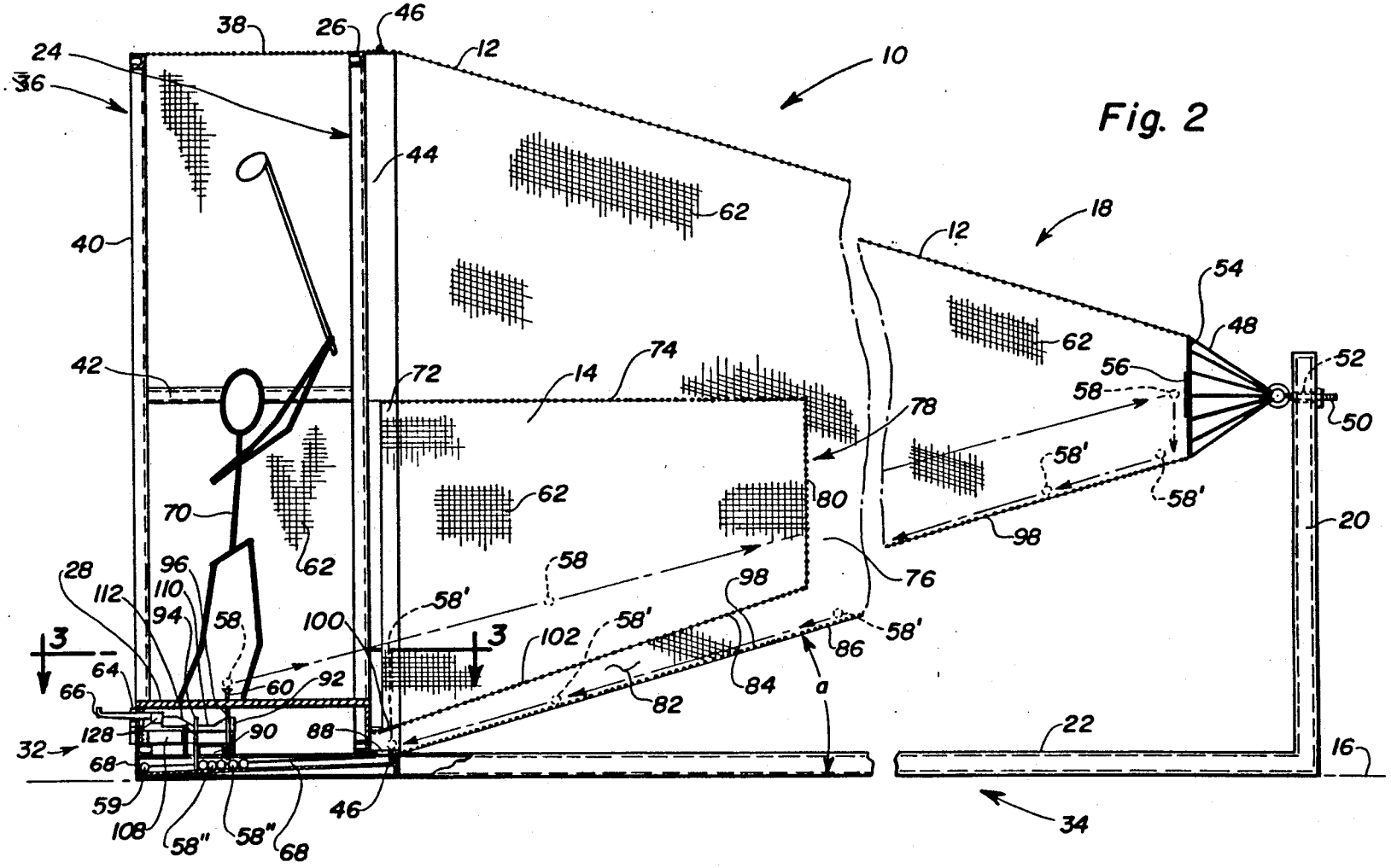
FIG. 2 is an enlarged vertical section of the golf ball driving practice apparatus generally as shown in FIG. 1, but being foreshortened to accommodate the same to the sheet.

Referring now to FIG. 2 in consideration of additional structural detail of said apparatus 10, as well as an explanation of the use and functional features thereof. Structurally, it will first be noted that the spent golf ball directing and return apron 14 is maintained in a shaped semi-circular configuration at the forward open base end 24 thereof, as best shown in FIG. 1, by a shaping frame collar 72 about which the open base end 24 is assembled and frictionally retained as best shown in FIG. 2. With the elongated apron side-wall ends 74 being wovenly assembled on either side thereof to the net sidewalls 76, the apron 14 presents a scoop-shaped configuration 78 suspendedly draped within the net 12 as shown in both FIGS. 1 and 2, with the semi-circular net divergent end 80 thereof open to form a semi-circular spent ball return channel 82 between the freely-hanging apron underside 84 and the open base end inclined net lower semi-circular surface 86 so that a spent golf ball 58' is gravity fed down the sloped net lower semi-circular surface 86 into the semi-circular spent ball return channel 82 for delivery to the golf ball receiving and dispensing means 32 by way of the spent ball return opening 88.

As the spent golf ball 58' drops through the spent ball return opening 88 it enters the golf ball delivery 68 which is a forward-inclined channel that gravity feeds the returned golf ball 58" to the ball dispensing and cut-off gate 90 of the golf ball receiving and dispensing means 32. It will be later shown and explained in greater detail, on considertion of FIGS. 4 through 6 hereinafter, that the ball dispensing and cut-off gate 90 operates by means of an elongated reciprocating cam 92 cycled by the coin release mechanism 66 to elevate a forward gate 94 to release and dispense returned golf balls 58" and deliver the same as dispensed golf balls 59, while at the same time and simultaneous therewith lowering a rear gate 96 to cut-off the dispensing of returned golf balls 58" which were not contained within the ball dispensing and cut-off gate 90 as that measured number of returned golf balls 58" to be dispensed with the deposit of coinage necessary to release the mechanism 66 to enable operation of the reciprocating cam 92 as previously described.

The golf ball driving practice apparatus 10 is simply employed by a player 70 who first operates the coin release mechanism 66 to receive that number of golf balls 59 delivered by coin dispensing, and then positioning himself on the support platform 28 he places a golf ball 58 upon the tee 60, and taking up a driving stance he aims for the impact target 56 and executes his practice drive. The trajectory of the golf ball 58 on a properly executed practice drive is upward and to the impact target 56 as shown, otherwise the ball 58 will hit the impact disk 54 or the net 12, the apron 14, or safety net 38. Except in the latter case where a golf ball 58 would be stopped by the safety net 38, forward momentum of the golf ball 58 by contained impact engagement with one or the other or more of the aforementioned restraining surfaces will be stopped, and thereupon as a spent golf ball 58' it will fall upon and roll down the open base end inclined net upper semi-circular surface 98 to the spent ball return opening 88, and falling therethrough be deposited in the golf ball delivery 68 for recycling to the ball dispensing and cut-off gate 90 as a returned golf ball 58". On continued practice driving utilization of the golf ball driving practice apparatus 10 as shown, by either the initial or subsequent players 70, the cycle of coin activated golf ball dispensing, player practice driving, and golf ball return is repeated as explained.

Figure 3:
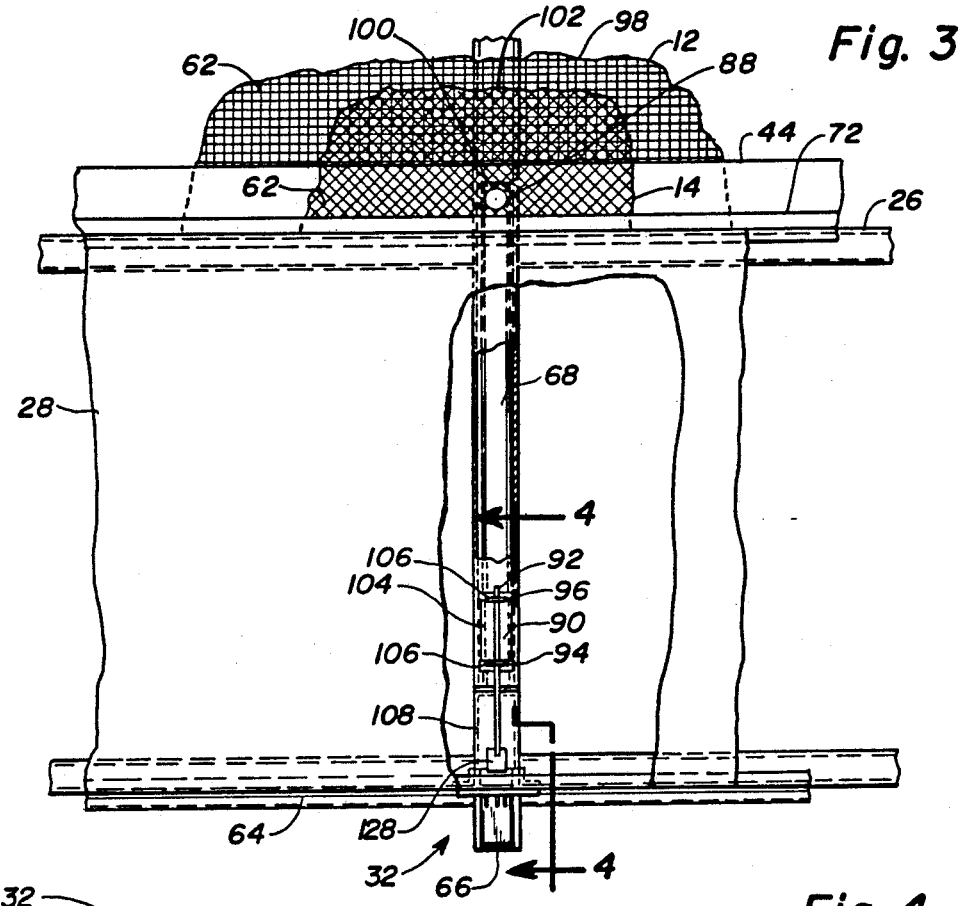
FIG. 3 is an enlarged top plan view of the golf ball collection and dispensing section of the golf ball driving practice apparatus as seen along the line 3–3 of FIG. 2, being reoriented to accommodate the same to the sheet.

Referring now to FIG. 3 to consider in greater detail additional structural aspects of the golf ball receiving and dispensing means 32, wherein some portions of FIG. 3 are cut away to better show certain of the structural features illustrated thereby. As previously described, entry of a spent golf ball from the net upper semi-circular surface 98 is by way of the spent ball return opening 88 therein. Also provided, however, is an apron spent ball return opening 100 in the spent golf ball directing and return apron 14, which apron opening 100 is on vertical alignment more-or-less with the net spent ball return opening 88 so that any spent golf ball that might inadvertently return by way of the apron upper semi-circular surface 102 will drop first through the apron opening 100 and then through the net opening 88 into the golf ball delivery 68 and then roll forward towards the forward gate 94. Also shown in FIG. 3 is the gate guide block 104 which contains vertical guide slots 106 adapted to respectively maintain the forward and rear gates 94 and 96 in vertically aligned position during vertical displacements respectively thereof on reciprocal displacement of the cam 92.

Also shown in greater detail in FIG. 3 is the coin release mechanism 66, which is a standard such device as is commonly used on various vending machines, game machines, in coin operated car washes, and the like. The golf ball receiving and dispensing means 32 is additionally provided with a coin receiving lock box 108 to receive and secure coins deposited in operation of the golf ball driving practice apparatus 10.

Figure 4:
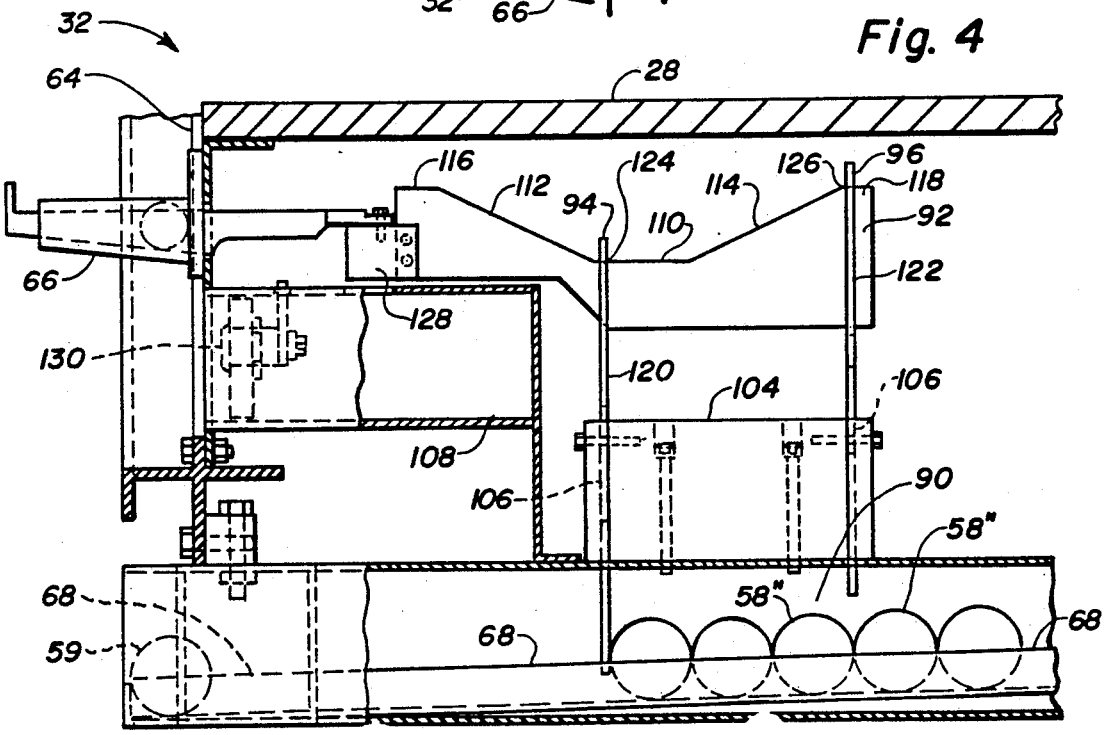
FIG. 4 is an enlarged side elevation view of the golf ball dispensing section as seen along the line 4–4 of FIG. 3.

The view shown in FIG. 4 is an enlarged side elevation of the golf ball receiving and dispensing means 32, and in particular the golf ball dispensing section thereof. As can be seen, the elongated reciprocating cam 92 is provided with five operational cam surface faces, being the centrally intermediate flat cam surface face 110, the forward inclined cam surface face 112, the rearward inclined cam surface face 114, the forward flat cam surface face 116, and the rearward flat cam surface face 118. The elongated reciprocating cam 92 reciprocally operates through centrally intermediate vertical slots respectively provided in the forward gate 94 and the rear gate 96, being respectively the forward gate slot 120 and the rear gate slot 122, and respectively within those slots upon the forward gate slot upper face 124 and the rear gate slot upper face 126. With the cam 92 positioned as shown, which is the returned golf ball 58" hold position, the forward gate 94 with its gate slot upper face 124 positioned forward on the centrally intermediate flat cam surface face 110 is lowered to block returned ball 58" passage and the rear gate 96 with its gate slot upper face 126 positioned forward on the rearward flat cam surface face 118 is elevated to allow returned ball 58" passage into the ball dispensing and cut-off gate 90 area. Specific coin initiated manually reciprocal operation of the cam 92 to effect ball holding and dispensing by effecting cooperative mechanical lowering and raising and visa versa respectively of the forward and rear gates 94 and 96 will be explained in detail on consideration of FIG. 5.

As further shown in FIG. 4, the cam 92 is mechanically assembled to the coin release mechanism 66, and supported in an outward projecting disposition therefrom, by means of a clevis connector 128. Additionally shown, the coin receiving lock box 108 is provided with a lock 130, which is of a standard type normally employed in such applications.

Figure 5:
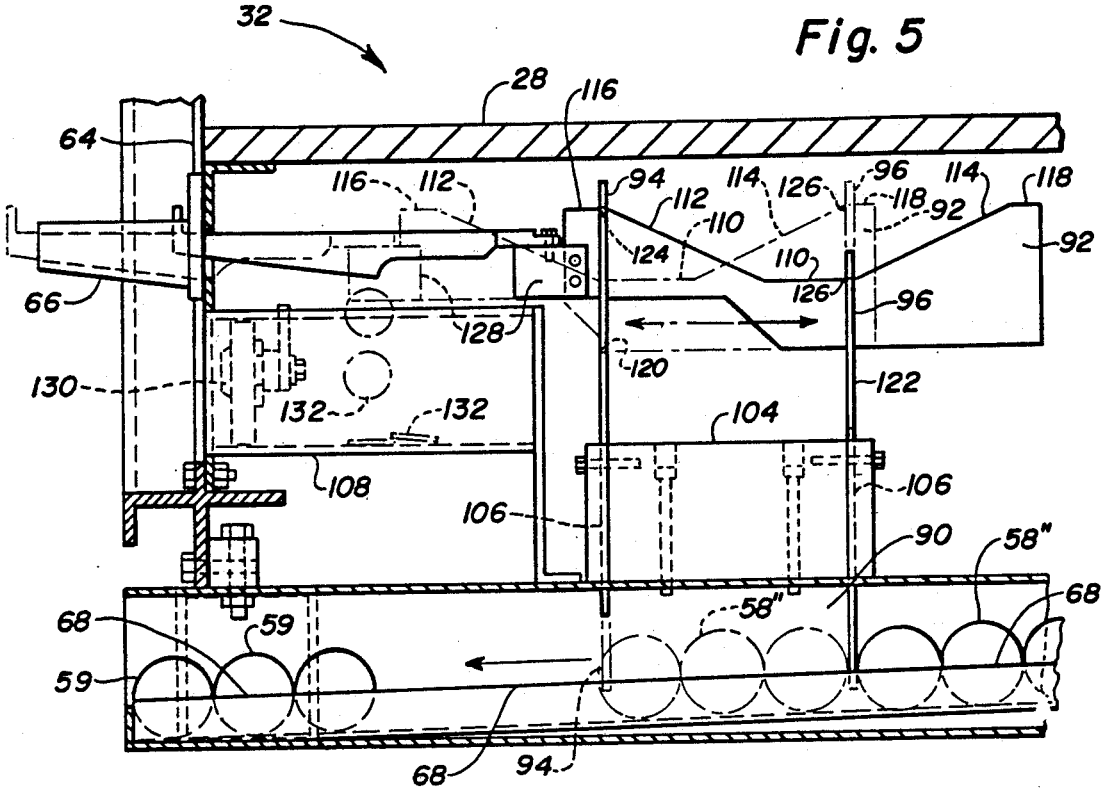
FIG. 5 is a side elevation view similar to that seen in FIG. 4, but herein illustrating the operational release and dispensing of golf balls from the golf ball dispensing section of said apparatus.

Referring now to FIG. 5 to consider in detail the mechanical operation of the golf ball receiving and dispensing means 32 in receiving, holding, and dispensing a measured number of returned golf balls 58" upon coin initiated manually reciprocal operation of the cam 92. The phantom line rendition of the returned golf balls 58", the coin release mechanism 66, the cam 92, and the forward and rear gates 94 and 96 as shown in FIG. 5 is the dispensing means 32 returned golf ball 58" hold position as illustrated in FIG. 4 and previously described on the detailed consideration thereof. Upon deposit of the requisite number and denomination of coins 132 in the coin release mechanism 66, and manually activated displacement thereof to advance the cam 92 to that position shown by solid line rendition in FIG. 5, the coins 132 are deposited in the coin receiving lock box 108, and simultaneously upon cam 92 advancement the forward gate 94 rises vertically in its vertical guide slot 106 as the forward gate slot upper face 124 of said gate 94 rises up the forward inclined cam surface face 112 of the advancing cam 92 to thereby release that number of returned golf balls 58" held within the ball dispensing and cut-off gate 90, and the rear gate 96 descends vertically in its vertical guide slot 106 as the rear gate slot upper face 126 of said gate 96 descends the rearward inclined cam surface face 114 of the advancing cam 92 to thereby block further delivery of returned golf balls 58" into the ball dispensing and cut-off gate 90 until such time as there is a manual retraction of the coin release mechanism 66 and the dispensing means mechanism is reciprocally returned to the phantom line rendition profile with the forward gate 94 in the lowered returned ball 58" blocking position and the rear gate 96 is in the elevated position. Thus, by the coin initiated manually reciprocal operation of cam 92 as above-described, the returned golf balls 58" are gathered, counted, and dispensed for re-use.

Figure 6:
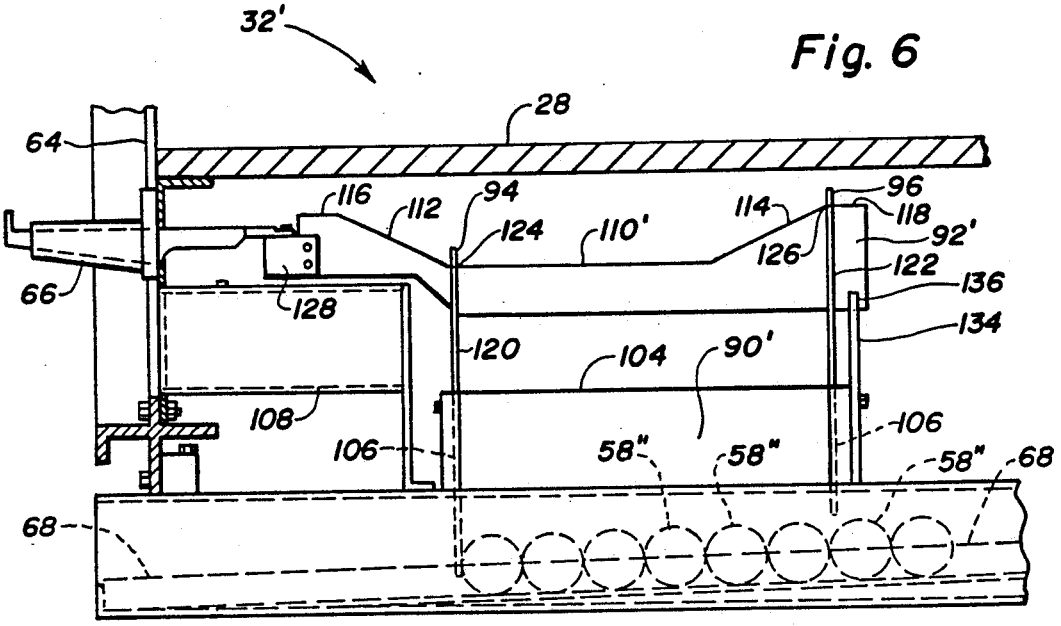
FIG. 6 is a side elevation view of an alternate golf ball dispensing section for the collection and release of a greater number of golf balls than previously shown.

Considering now the view shown in FIG. 6, which is a simplified side elevation similar to that as previously illustrated in FIG. 4, but herein depicting an extended golf ball receiving and dispensing means 32' embodying the use of an extended reciprocating cam 92 having an extended centrally intermediate flat cam surface face 110' to provide an extended ball dispensing and cut-off gate 90' so that a greater plurality of returned golf balls 58" may be measured out for coin operated dispensing, which as shown, being exemplary only of such plurality, is six. As also shown, to provide both stability and guidance for the extended reciprocating cam 92' on coin initiated manually reciprocal operation thereof, a cam support guide 134 is provided with a cam receiving complementary notch 136 within which the cam 92' is guided and supported as it is operationally cycled.

Considering lastly and together the views shown in FIGS. 7 and 8, which are multi-player position golf ball driving practice apparatus, being in the case of FIG. 7 a dual player golf ball driving practice apparatus 138 and in the case of FIG. 8 a triple player golf ball driving practice apparatus 140. In the cases of providing a multi-player position apparatus, the supporting frame structure, net, and impact disk take on an oval configuration as shown. Otherwise, the structure, operation, utility, and use of a multi-player position apparatus whether dual 138 or triple 140, or some other player plurality, is the same as previously described in detail for the basic single player golf ball driving practice apparatus 10.

Another alternate version of the golf ball driving practice apparatus 10 is a simplified embodiment thereof which is essentially the same as that shown in FIG. 1 except that the golf ball receiving and dispensing means 32 is comprised only of the golf ball delivery 68 without the coin release mechanism 66, and the spent golf ball directing and return apron 14 is eliminated. The simplified version as above-described being intended for use by individuals as a private golf ball driving practice means for back yard installation or the like.

Although the invention has been herein shown and described in what is conceived to be the most practical and preferred embodiment, it is recognized that departures may be made therefrom within the scope thereof, which is not to be limited to the specific details disclosed herein but is to be accorded the full scope of the claims so as to embrace any and all equivalent golf ball driving practice apparatus adapted for use in either indoor or outdoor driving range applications as well as use at various convenient golf course locations so that a golfer on the golf course is enabled to practice drive golf balls near a playing tee without the bother or inconvenience of interfering with other players or having to retrieve the balls.

I claim:

1. A golf ball driving practice apparatus comprising in combination, a stretched, flexible, truncated, conical mesh net and a frame assembly adapted to suspend and stretch said truncated conical shaped golf ball receiving and return net with its net divergent end thereof connected to a turnbuckle on said frame assembly, and its open end to a net opening and connecting frame connected to said net open end, said net divergent end including a solid, circular impact disc for holding the net material divergent and providing a wear resistant impact target at which the players aim, a player positioning and support platform at said open a end of said net, and a golf ball receiving and dispensing means provided within the enclosure of said platform and adapted to receive spent golf balls after being practice driven by a player with means to release said golf balls for reuse.

2. The golf ball driving practice apparatus according to claim 1 wherein said interconnected net supporting and stretching frame assembly is comprised of an L-shaped member.

3. The golf ball driving practice apparatus according to claim 1 wherein said truncated conical shaped golf ball receiving and return net is provided with a spent golf ball directing and return apron.

4. The golf ball driving practice apparatus according to claim 1 wherein said net opening and connecting frame is circular in shape.

5. The golf ball driving practice apparatus according to claim 4 wherein said platform is adapted to accommodate a single player.

6. The golf ball driving practice apparatus according to claim 5 wherein said platform is provided with a tee.

7. The golf ball driving practice apparatus according to claim 1 wherein said net opening and connecting frame is oval in shape.

8. The golf ball driving practice apparatus according to claim 7 wherein said platform is adapted to accommodate a plurality of players.

9. The golf ball driving practice apparatus according to claim 8 wherein said plurality of players is two.

10. The golf ball driving practice apparatus according to claim 8 wherein said plurality of players is three.

11. The golf ball driving practice apparatus according to claim 8 wherein said platform is provided with a plurality of tees corresponding in number to the plurality of players accommodated thereby.

12. The golf ball driving practice apparatus according to claim 7 wherein said conical shaped golf ball receiving and return net is provided with a spent golf ball directing and return net.

13. The golf ball driving practice apparatus according to claim 1 wherein said dispensing means is coin operated.

14. The golf ball driving practice apparatus according to claim 1 wherein said apparatus is installed at a golf ball driving range.

15. The golf ball driving practice apparatus according to claim 1 wherein said apparatus is installed at a golf course facility.

16. A golf ball driving practice apparatus comprising in combination, a stretched, flexible, truncated, conical mesh net and a frame assembly adapted to suspend and stretch said truncated conical shaped golf ball receiving and return net, with said net extending from a net divergent end thereof to a net opening end, and a connecting frame connected to said net opening end, said net divergent end including a solid, circular impact disc for holding the net material divergent and providing a wear resistant impact target at which the players aim, a player positioning and support platform at the open end of said net, and a golf ball receiving and dispensing means provided within the enclosure of said platform and adapted to receive spent golf balls after being practice driven by a player.

17. The golf ball driving practice apparatus according to claim 16 wherein said interconnected net supporting and stretching frame assembly is comprised of an L-shaped member.

18. The golf ball driving practice apparatus according to claim 16 wherein said net opening and connecting frame is circular in shape.

19. The golf ball driving practice apparatus according to claim 18 wherein said platform is adapted to accommodate a single player.

20. The golf ball driving practice apparatus according to claim 19 wherein said platform is provided with a tee.

* * * * *